United States Patent [19]

Margulefsky et al.

[11] Patent Number: 4,480,446

[45] Date of Patent: Nov. 6, 1984

[54] METHOD AND APPARATUS FOR REHABILITATING REFRIGERANT

[76] Inventors: Allen L. Margulefsky, 1038 Peninsula Blvd., Woodmere, N.Y. 11598; James F. Lutz, 13 John La., Levittown, N.Y. 11756

[21] Appl. No.: 271,447

[22] Filed: Jul. 8, 1981

[51] Int. Cl.[3] ..... F25D 11/02

[52] U.S. Cl. ..... 62/474; 62/292

[58] Field of Search ..... 62/77, 292, 474, 303, 62/298, 475; 55/389

[56] References Cited

U.S. PATENT DOCUMENTS

| | | | |
|---|---|---|---|
| 2,341,430 | 2/1944 | Elsey | 62/77 |
| 2,600,435 | 6/1952 | Shapiro . | |
| 3,175,342 | 3/1965 | Balogh | 62/474 |
| 3,572,050 | 3/1971 | Bottom | 62/85 |
| 3,699,781 | 10/1972 | Taylor | 62/85 |
| 3,759,062 | 9/1973 | Wrenn et al. | 62/474 |
| 3,785,164 | 1/1974 | Wrenn | 62/129 |
| 3,793,846 | 2/1974 | Dehne | 62/6 |
| 4,104,044 | 8/1978 | Lange | 62/324 |
| 4,180,988 | 1/1980 | Forte et al. | 62/474 |

OTHER PUBLICATIONS

Althouse et al., "Modern Refrigeration and Airconditioning" Goodheart-Willcox Company, 1979 pp. 374, 375, 376, 538-541.

*Primary Examiner*—Albert J. Makay
*Assistant Examiner*—Henry Bennett
*Attorney, Agent, or Firm*—Nolte, Nolte and Hunter

[57] ABSTRACT

A method and apparatus for cleaning and filtering contaminants from the refrigerant in a refrigeration system does not permit any gaseous refrigerant to escape to the atmosphere during repair of the system. A tank containing a disc of filter material has piercing valves connected to an inlet and an outlet. The tank and filter are connected to the contaminated system by the piercing valves, the contaminated refrigerant passes through the filter and is retained in the tank. Once the system is repaired, the refrigerant passes from the tank and filter into the system, but the tank and filter remain connected thereto while the system is operated. The tank and filter are removed after a time sufficient to clean the refrigerant.

13 Claims, 7 Drawing Figures

METHOD AND APPARATUS FOR REHABILITATING REFRIGERANT

BACKGROUND OF THE INVENTION

The present invention relates to refrigerant filtering and, more specifically, relates to a specialized method and apparatus for retaining and reconditioning fluorocarbon refrigerants.

The refrigeration industry has grown tremendously since the development of modern manufacturing techniques and the electrification of the country. In fact, refrigeration is presently the ninth largest industry in the United States. Almost every office building and manufacturing facility constructed within the last twenty years is at least partially air conditioned, and many homes are air conditioned as well. At some time during the life of the electro-mechanical refrigeration system, one or more of the units making up the system malfunctions and repair or replacement will be required. This typically involves disassembly of the sealed-gas system and replacing the fluorinated hydrocarbons (fluorocarbons) that are used as the refrigerant.

In industrial air-conditioning and refrigeration installations the units are quite large and employ relatively large horsepower electric motors to operate the compressors and blowers. In some systems the motor is integrally formed with the compressor and is arranged inside the compressor case. In any event, all electric motors are subject to burnout. Whether caused by a malfunction or just old age, the windings of the motor overheat and reach a temperature at which the insulation is destroyed and the windings become shorted out. While this situation is undesirable from the standpoint of replacing the motor, it is even more troublesome from the refrigeration system standpoint. This is so because typically when the motor burns out the compressor also reaches a very high temperature and, in the case where the refrigerant actually passes over the motor windings, the refrigerant will be substantially contaminated by carbon particles and other undesirable particulate hydrocarbons which are formed at this high temperature. It is then necessary not only to repair/replace the burned-out motor and compressor system but also to replace the fluorocarbon refrigerant. The common practice in the industry today is simply to vent the sealed system to the atmosphere and to permit the refrigerant, such as Freon, to escape into the atmosphere. This practice adds to the cost of the repairs, since this refrigerant is not inexpensive. Then it is often the customary practice to clean the system with a liquid refrigerant solvent, e.g., R-11 or Freon 11. It is understood that at normal ambient temperatures and under standard atmospheric pressures the liquid refrigerant will boil and is driven off as a gas. This practice of venting the refrigerant to the atmosphere has proven to be convenient and, once the repairs have been completed, the system is recharged using fresh refrigerant.

While permitting the refrigerant to escape into the atmosphere does present some cost disadvantages, there is apparently an even greater disadvantage. Recent scientific theories (based on laboratory modeling) have been advanced that the presence of flourinated hydrocarbons depletes the ozone layer surrounding and protecting Earth. This concern has been reflected in a recent federal ban on fluorocarbons for use as an aerosol propellant. Also, legislation has been proposed to limit the production of fluorocarbons to a level equal to 30% of the 1979 level of production. Accordingly, it is desirable if at all possible to prevent excessive escape of fluorocarbons into the atmosphere and also to conserve the supply of manufactured fluorocarbons.

SUMMARY OF THE INVENTION

The present invention provides a method and apparatus for rehabilitating contaminated refrigerant in a refrigeration system without permitting such refrigerant to escape to the atmosphere. Additionally, the invention provides easily portable apparatus which may be taken to the site of the refrigeration unit, installed, and then left in place for a period of time before its ultimate removal. Accordingly, the use of the present invention precludes the requirement to transport large and heavy drums of refrigerant to difficult places, such as up ladders and onto the roof of a building where air-conditioning units are typically located. Alternatively, the inventive apparatus could be used as a permanent installation.

The inventive method involves installing the inventive apparatus onto the existing refrigeration system and then causing the contaminated refrigerant in the system to flow into it. The system is then repaired as necessary and the malfunctioning or burned-out units replaced, while the refrigerant is retained in the inventive apparatus. Then, the retained refrigerant that has been partially rehabilitated by its passage into the inventive apparatus is caused to flow back into the system. At that time the system is returned to its normal duty; however, the inventive apparatus remains connected in the refrigeration line of the system. Thus, during actual operation of the refrigeration system the inventive apparatus is continuously performing its refrigerant rehabilitation and reconditioning function. Once a sufficient period of operating time has elapsed, during which time the refrigerant has been continuously flowing through the inventive apparatus and constantly being cleaned, the inventive apparatus is removed from the system and a line filter/dryer connected in place to remove any residual contamination or moisture. Additionally, the oil in the compressor may also be changed at that time.

The present invention provides apparatus that, in one embodiment, comprises special piercing valves for connection into the lines of the refrigeration system and a filtering unit having a specially formed replaceable filter element located inside a special holding tank. The inventive filtering unit is chosen to be large enough to retain the entire volume of refrigerant typically used in a standard air-conditioning unit, while still being portable. Larger retaining units could be employed, however, with some sacrifice in portability. Nevertheless, a number of the retaining units may be connected in series to accommodate any size refrigeration system encountered or several units can be connected and disconnected sequentially, in order to hold all of the refrigerant. The method of the present invention employs this apparatus in a particular sequence of steps to connect the filtering unit to the refrigeration system, to filter and retain the refrigerant during repairs, and then to clean continuously the refrigerant while it is in use in the system.

Therefore, it is an object of the present invention to provide a method and apparatus which permits rehabilitation of refrigeration-system refrigerant without permitting such refrigerant to escape into the atmosphere.

It is another object of the present invention to provide a relatively portable apparatus for use in cleaning and rehabilitating refrigerant, which apparatus may be transported to the site of the refrigeration system with a minimum of effort.

It is still another object of the present invention to provide a method for rehabilitating refrigerant without permitting such refrigerant to escape into the atmosphere.

It is a further object of the present invention to provide a specially configured filter element for use in the inventive apparatus.

The manner in which these and other objects are accomplished by the present invention will become clear from the following detailed description.

DETAILED DESCRIPTION OF THE INVENTION

Figure 1:
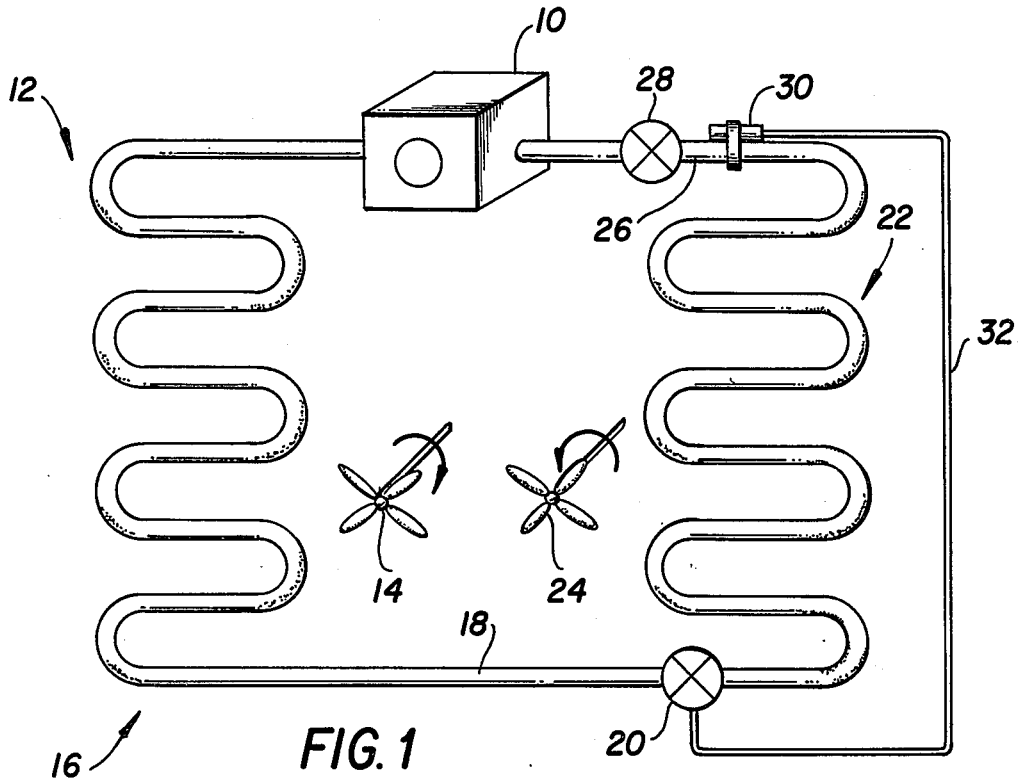
FIG. 1 is a schematic of a conventional refrigeration system.

Referring now to FIG. 1, the basic elements of a typical refrigeration system are shown in schematic form. Specifically, a compressor 10 has a condenser coil 12 connected to its high-temperature, high-pressure output side adjacent which is located a conventional blower 14. The refrigerant contained within the condenser coil 12 at location 16 is generally in a liquid state and passes through a liquid line 18 to the expansion value 20. The evaporator coil 22 comprises the low-temperature, low-pressure side of the refrigeration system and is connected to the other side of the expansion valve 20; another blower 24 is arranged adjacent the evaporator coil 22. A return line 26 then feeds the refrigerant to the suction valve 28 and thence to the compressor 10, where the refrigerant gas is compressed again and the cycle continues. In order to control the efficiency of the system of FIG. 1, an expansion valve bulb 30 is arranged in the output side of the evaporator coil 22 and is connected via a capillary tube 32 to the expansion valve 20. This is a feedback system to control the operation of the expansion valve 20.

In the normal failure situation it is usually the motorized compressor 10 that burns out and contaminates the refrigerant in the system. Thus, during a conventional repair the system is broken at convenient spots, such as the inlet and outlet to the compressor, and the contaminated refrigerant is permitted to boil off and escape into the atmosphere. It is a known practice to heat the liquid refrigerant to cause it to boil off more rapidly. Once the original refrigerant has escaped, it is frequently common practice to flush the system with R-11 refrigerant solvent. This is a further waste of refrigerant, as well as involving additional costs. A new compressor is installed, or the existing one repaired, and the system is recharged with fresh refrigerant. Nevertheless, it is impossible to remove all of the contaminants from the system since they adhere to the inside of the tubes and coils of the system after the gaseous refrigerant has been driven off. Thus, when reinstalling or repairing the system it is standard practice to install a line filter/dryer to capture all of the contaminants and moisture remaining in the system.

Figure 2:
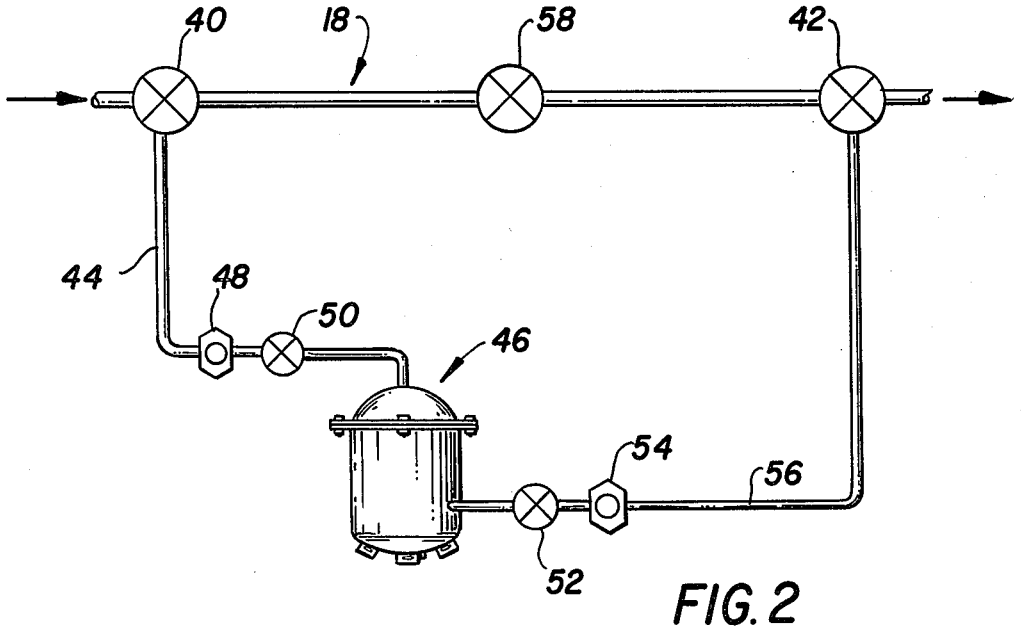
FIG. 2 is a schematic of the inventive rehabilitation system.

Turning to FIG. 2, the present invention is shown schematically. Specifically, piercing valves 40, 42 are provided at the inlet and outlet points, respectively, of the inventive system. These valves 40, 42 can be of the type known as saddle valves, piercing valves, line-tap valves, or T-off valves, and the function of these valves will be explained in more detail hereinbelow.

The line 44 from T-off valve 40 is connected to the inventive filtering unit 46 through a sight glass 48 and control valve 50. The construction and functioning of the inventive filtering unit 46 is disclosed in detail in FIG. 4 hereinbelow. The outlet of the filtering unit 46 is fed through a second control valve 52, sight glass 54, and through pipe 56 to the exit T-off valve 42. The T-off valves, 40 and 42, are typically of the kind that may be installed without breaking the existing pipe and are positioned around the pipe and clamped securely by means of bolts or the like, thereby piercing the existing pipe and providing a valved fluid connection thereto. A refrigerant line valve 58 is provided for connection in the refrigerant line 18 and in combination with inventive filtering units serves to provide the correct back pressure to the compressor 10 in order to stabilize it. The function of this valve 58 will be explained in more detail below.

The valving portions of the T-off valves 40, 42 act to place the additional pipe, for example 44 in FIG. 2, in fluid communication with the refrigerant line, depending upon the manual actuation of the valving portion.

Some larger refrigeration systems employ what is known as a "king" valve, typically located in the refrigeration system at 16. A "king" valve serves to shut off the flow of refrigerant through the system and also provides a point at which to make an external fluid connection to the system, typically to connect a gauge manifold or to charge the system with refrigerant. In the case where a "king" valve is present, piercing valve 40 is not required and the system can be entered at the "king" valve by a threaded connection. The refrigerant line valve 58 and the outlet side piercing valve 42 are still required, however.

Figure 3:
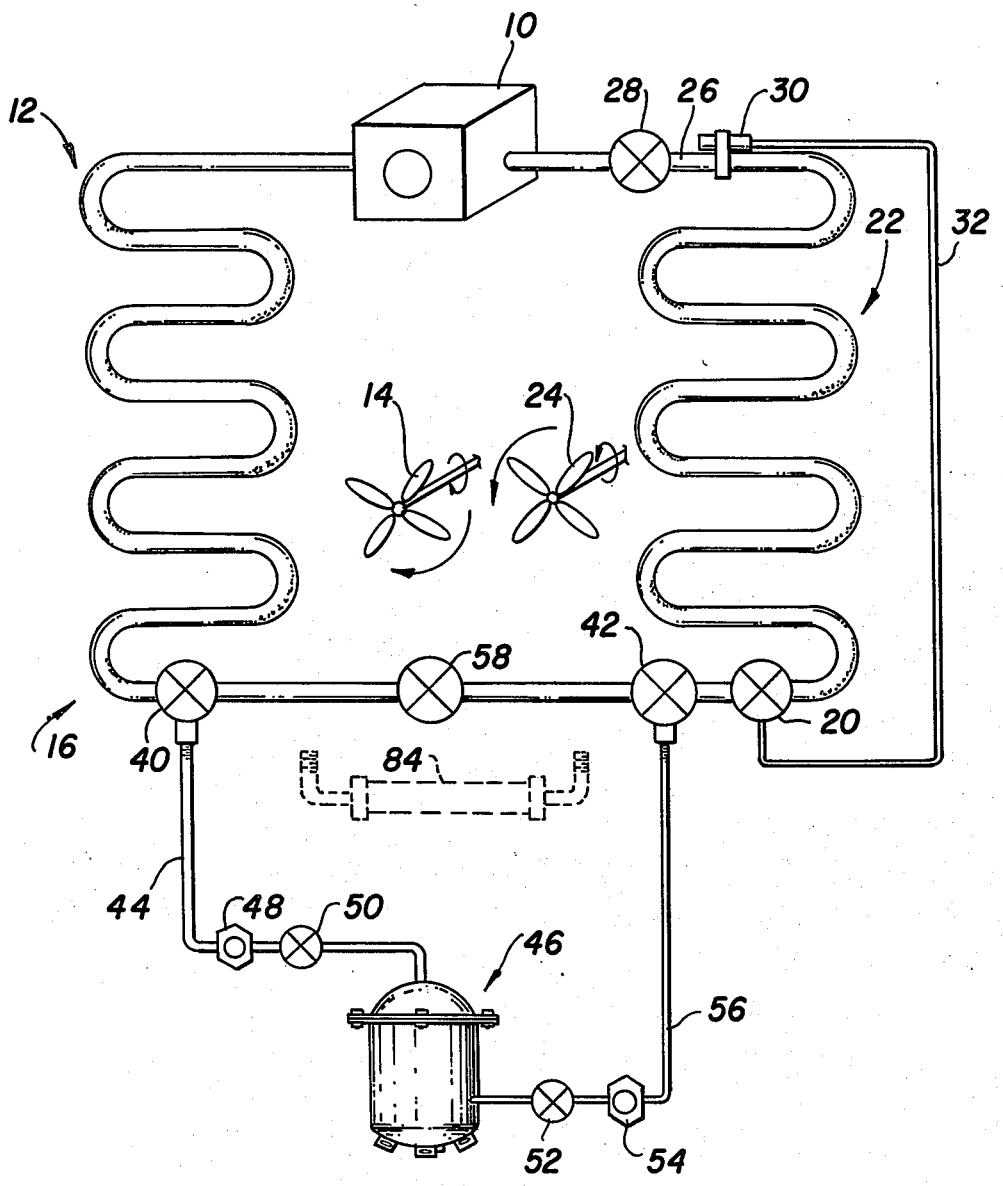
FIG. 3 is a schematic showing the system of FIG. 1 having the inventive apparatus installed thereon.

FIG. 3 shows schematically the apparatus of FIG. 2 installed in an existing system similar to that shown in FIG. 1. In FIG. 3 the T-off valve 40 is connected in liquid line 18 at the high-temperature side 16 of the condensor coil 12; refrigerant line valve 58 is connected in line 18 and T-off valve 42 is connected in line 18 at the input side of the low-pressure, low-temperature evaporator coil 22. At the time of installation, both T-off valves 40, 42 are shut off and do not permit refrigerant to flow into the inventive filtering system. Valve 40 is installed in liquid line 18 and is connected via a standard refrigerant manifold or refrigerant hose 44 to the sight glass 48 and valve 50. The tank 46 has previously been evacuated and, upon opening valves 40 and 50, the refrigerant in liquid line 18 flows immediately into the filtering unit 46. There is no flow out of the filtering unit because valve 52 remains closed. The refrigerant will flow through the filter in filtering unit 46 to the bottom of the tank. If the refrigeration system is large, one tank may be filled, valves 40 and 50 closed, the connection at valve 40 broken and a fresh, evacuated, filtering unit connected. Alternatively, the inlet of a fresh, evacuated filtering unit can be connected to the outlet of the first connected unit, for example, 60 pounds of refrigerant may require three separate filtering units. As a second alternative a larger unit 46 could be employed to hold all of the refrigerant in the typical larger system.

The liquid line 18 from the receiver or condensor 12 to the expansion valve 20 is then pinched off at a point which will subsequently be convenient for the installation of the refrigerant line valve 58. Valve 50 is then closed and, when the refrigerant system is no longer under pressure, repair work may proceed, e.g., the damaged compressor 10 may be removed from the system, repaired and reinstalled, or other repairs made as required. After repairs have been made, the pinched-off section is cut out and valve 58 installed. Valve 42 is also then installed in line 18 downstream of valve 58. It is then necessary to recharge the system with refrigerant, using a standard vacuum pump (not shown) the repaired system is evacuated, and T-off valve 42 is opened as is control valve 52, thereby to permit the stored, partially rehabilitated refrigerant to flow out of the filtering unit 46 back into the high-pressure, high-temperature side of the evaporator coil 22. If more than one filtering unit was required, then each is connected to give up its stored refrigerant. Valves 40, 42, 50, and 52 are opened, the refrigeration system is then started up and operated, and valve 58 is opened partially and adjusted to achieve a proper back pressure to provide optimum operation of the compressor. Thus, part of the refrigerant flows through valve 58 in liquid line 18 and part through the filtering unit 46. In a departure from conventional techniques, the inventive apparatus remains connected in the refrigeration system while it is running and, thus, the contaminated fluorocarbons are continuously passed through the filtering unit 46. After a predetermined period of time, for example, one week, the service man returns to the installation and determines the cleanliness of the refrigerant by inspecting sight glasses 48 and 54. Once the refrigerant is seen to be clean, valves 40 and 42 are closed, valves 50 and 52 are closed, and valve 58 is opened to its fullest extent. Lines 44 and 56 are then broken at valves 40 and 42, respectively and these connections are now available for the connection of a liquid line dryer, shown in phantom at 84.

Figure 4:
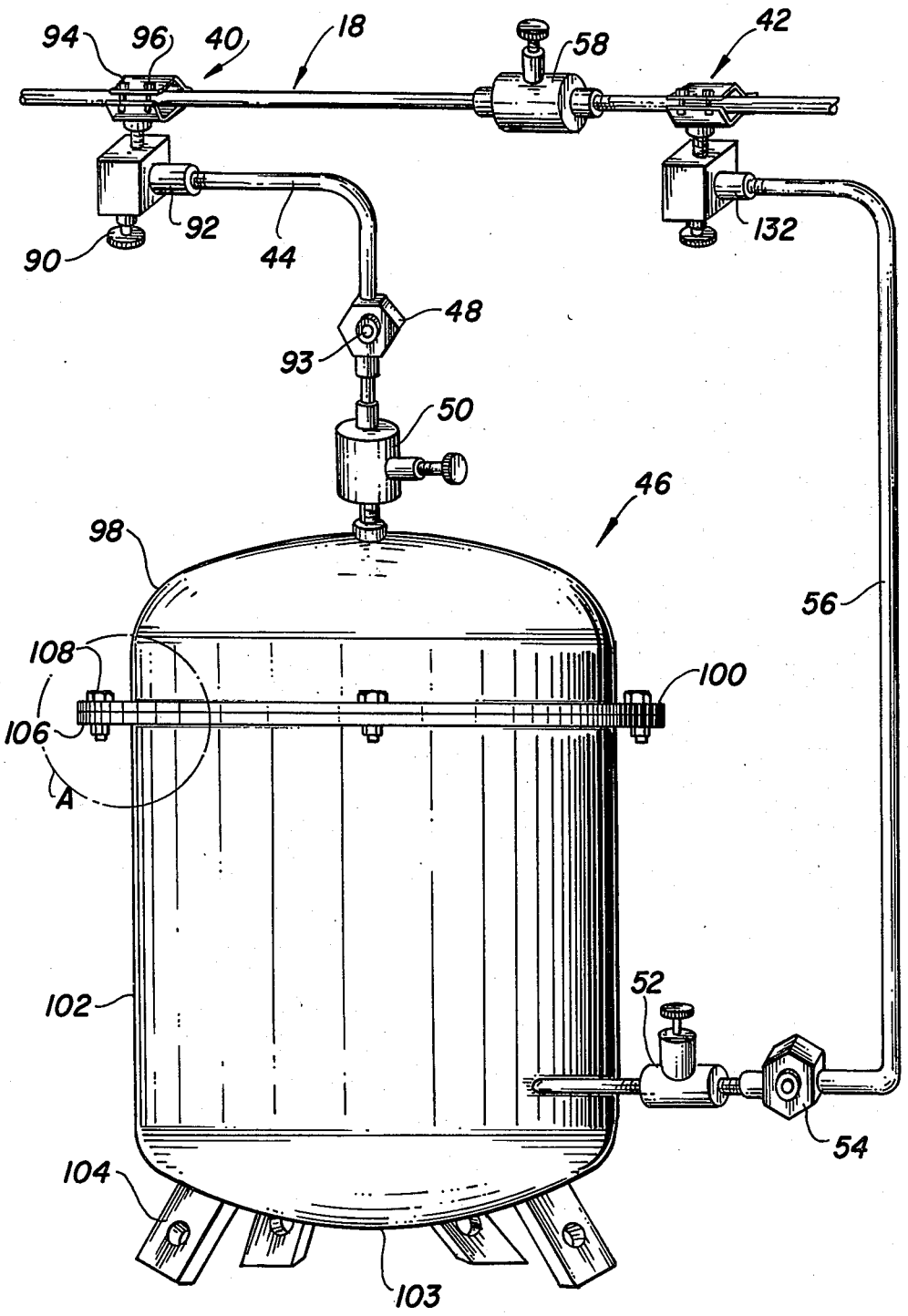
FIG. 4 is a perspective of the filtering unit of the inventive refrigerant rehabilitation system.

Referring now to FIG. 4, one embodiment of the apparatus of the present invention is shown in a perspective view, wherein T-off valve 40 includes a control knob 90 and has an outlet connection 92 to which is connected the inlet hose 44. The other end of hose 44 is connected to the sight glass 48 which has a transparent window 93 through which the cleanliness of the refrigerant can be viewed. From the sight glass 48 the refrigerant flows to the control valve 50 and thence to the inventive filtering unit 46. Valves 40 and 42 are of the type which are clamped around a pipe at some point along its length and the halves of the valve bolted together to pierce the pipe in order to make a fluid connection to the existing line 18. Two such bolts are shown at 94 and 96 in relation to valve 40. T-off valve 42 is identical to valve 40.

The filtering unit 46 is an assembly consisting of a two-piece cylindrical tank body, to the lowermost portion of which is connected the outlet control valve 52. The top portion of the tank is a dome shaped element 98 having an outer circumferential rim 100 at is open end. The lower portion of the tank is a tubular element 102 having a domed bottom 103 to which are attached legs or feet, shown typically at 104, to keep the unit upright. The lower element 102 has an outer circumferential rim 106 at is open end. The two rims 100 and 106 are bolted together in a sealing manner by bolts, washers, and nuts shown typically at 108. A seal element (not seen in FIG. 4) is firmly clamped between the rims 100 and 106 which also cooperate to retain the filter element inside the tank assembly. Area A represents the area to be cut away in FIG. 5 to show the arrangement of the seal, filter, and the like. The two-piece tank body contains a disc-shaped filtering element, which is located to separate the internal volume of the tank body so that at least two thirds of the volume of the tank is below the filter.

The disc-shaped filtering element is in the form of a wafer having a special constructed upper surface and is sealingly fitted against the inner surface of the vertical sides of the cylindrical tank body so as to prevent any contaminated fluorocarbons from flowing around the filtering element. The filtering element can be constructed having a thickness dependent upon the specific filter material used. The filter element may be formed of activated alumina (aluminum oxide), of cellulose fibers, of a chemically inert, bead-type desiccant forming a molecular seive when compressed into the required wafer form, or a combination of any of these, and is shown in detail in FIGS. 6 and 7.

Figure 5:
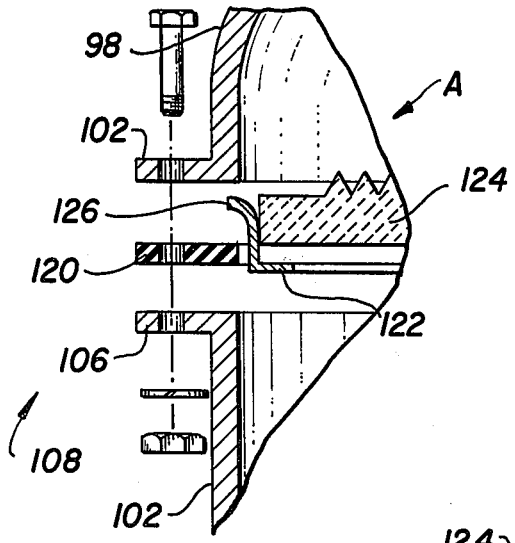
FIG. 5 is a detail in cross section of a portion of the unit of FIG. 4 showing the filter element arranged therein.

FIG. 5 shows the detail area A cut away and exploded so that a portion of the interior of the tank body is revealed. Arranged between the upper rim 100 and the lower rim 106 is a flat circular seal member 120 or gasket having appropriately located clearance holes formed therein so that the bolt assemblies 108 can pass therethrough. A circular metal retaining ring 122 is provided for retaining the filter element 124 within the tank body. The ring 122 has an open central portion and has an outer outwardly and upwardly curved rim 126. The rim 126 rests on the gasket ring 120 and is supported by the outer rim 106 of the lower body portion 102. The retaining ring 122 has an inner diameter only slightly greater than the outer diameter of the filter element 124 so that the filter element is firmly grasped around its circumference by the ring 122. The ring 122 and filter element 124 are arranged to rest on the gasket 120 and the upper portion bolted to the bottom portion; bolting the rims together has the effect of deforming the gasket 120 so that a gas-tight seal is formed. The rim also prevents any contaminated refrigerant from flowing around the filter element 124.

In alternate embodiments, the filtering element could be retained by several clips welded to the inside of the tank body or supported by an open gridwork spanning the inner diameter of the tank body. The filter element may rest by its own weight on the retaining means or a compression spring can be used to keep the filter in position. The filter element should be in a sealing relationship with the inside wall of the tank to prevent contaminated refrigerant from flowing therearound.

Figure 6:
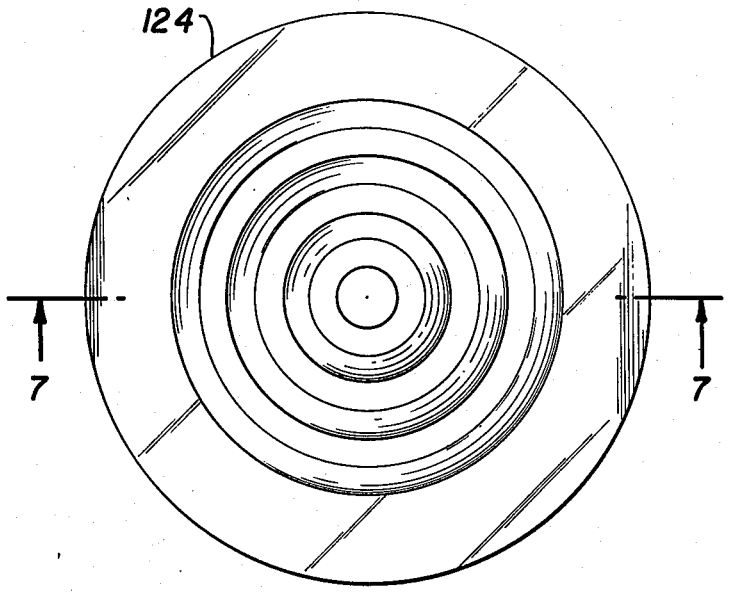
FIG. 6 is a top plan view of the inventive filter element.
Figure 7:
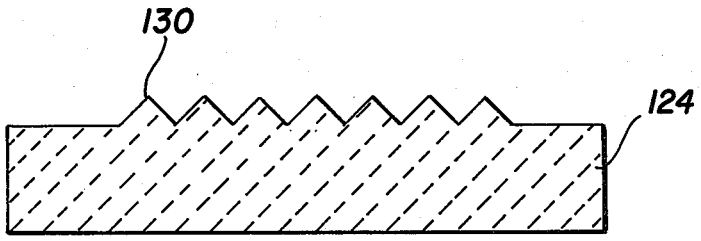
FIG. 7 is a cross section of the filter element of FIG. 6 taken along lines 7—7.

FIGS. 6 and 7 show the inventive filter element 124 in detail. In this embodiment the upper surface of the filter element is formed with concentric raised pointed rings, shown typically at 130. In cross section each ring 130 forms a triangular upraised portion on the surface of the filter element 124. This presents added filter surface area to the contaminated refrigerant and also permits the particulate contaminates to be retained on the surface of the filter. The upper surface could also have a surface similar to a waffle, or it could have a pattern of upraise pyramidal prisms arranged in grid.

In the operation of the inventive filtering unit 46, the tank containing the filtering element 124 is connected either at valve 50 or 52 to a standard refrigeration system vacuum pump (not shown) and the interior of the tank body, 98 and 102, evacuated to a partial vacuum, valves 50 and 52 are then closed. After connecting the T-off valve, 40 to the liquid line 18, valves 40 and 50 are opened and the partial vacuum in the tank causes the flow of liquid refrigerant from liquid line 18 into the tank to start immediately. Valves 40 and 42 can be installed in the line without breaking it and, typically, bolts or screws are tightened to clamp the valve halves around the pipe. The refrigerant flows through sight glass 48 and valve 50, falls onto the filtering element 124 and passes therethrough, thereby removing particulate and chemical contaminants. The central area will probably be the first area of the filtering element 124 to become clogged; however, the refrigerant can still pass easily through those areas not occluded by contaminants. Once a filter element becomes clogged, i.e., dirty, it can be easily and quickly changed by removing the bolts 108, lifting off the upper portion 98, removing the dirty filter and replacing the filtering element 124. The metal ring 122 can be reused or replaced as desired. The cost of the filter elements is such in relation to the cost of the refrigerant normally required to recharge a system that a clean filtering element 124 can be used for each new job.

Once the refrigeration system has had the refrigerant passed into the tank, retained therein, and the pressure in the system removed, the pinched-off portion of line 18 is cut out and line valve 58 installed. In small systems, where the size of hoses 44 and 46 approximate those of the system, it may not be necessary to cut out the pinched-off portion and a liquid line dryer can be connected to the remaining valves 40 and 42 once the repair work has been completed and the tank is to be disconnected. This liquid line dryer, 84 in FIG. 3., then provides the fluid communication originally provided by line 18 and presents the same back pressure to the compressor 10.

A typical sequence of events then in practicing the inventive method following a burnout of a compressor motor involves the following steps, with reference to FIGS. 3, 4 and 5. A piercing valve 40 is connected in the liquid line 18 and a tank containing a filter element and having a partial vacuum pulled therein is connected to the piercing valve 40 by a refrigerant hose 44 through a sight glass 48 and an inlet control valve 50. The valves 40 and 50 are opened and the vacuum causes the refrigerant to flow into the lower tank portion 102 through the filter element 124. The liquid line 18, connecting the condenser coil 12 and the evaporator coil 22, is pinched off at a convenient location for the installation of an in-line refrigeration valve. The contaminated refrigerant has fallen down onto and the partially rehabilitated refrigerant passed through filtering element 124, thus, beginning the refrigerant reconditioning process. The refrigerant is retained in the lower tank portion 102 below the filtering element 124, by closing valves 40 and 50. In the event that the refrigeration system is so large as to use more refrigerant than can be held in tank, one or more identical tanks can be connected in series. Each of these additional tanks should be provided initially with a partial vacuum to hasten refrigerant flow.

Once all of the contaminated refrigerant is retained in the tank, repairs as needed can be made to the system. After all repairs are made, the retained, partially cleaned refrigerant must be fed back into the system. First the pinched-off section is removed and valve 58 inserted in line 18. Then, the second piercing valve 42 is installed in line 18. The refrigeration system is evacuated using a conventional vacuum pump and valve 42 is connected to the outlet valve 52 and sight glass 54 by refrigeration hose 56. Valves 52 and 42 are then opened causing all of the refrigerant to flow back into the refrigeration system. When all valves are open the system is operated and the compressor back pressure is stabilized by throttling line valve 58 and insuring proper pressures. This has the effect that at least part of the refrigerant is continuously passed through the filtering element 124 and its purity increased with each pass. The surface area of the filtering element 124 is chosen sufficiently large so that it can not possibly be completely contaminated by this continuous cleaning operation.

After a predetermined length of operating time has elapsed, the sight glasses, 48 and 54, are inspected and, upon determining that the refrigerant has been adequately rehabilitated, the inventive apparatus can be removed from the system. This is accomplished by closing valves 40 and 42, then closing valves 50 and 52 and opening valve 58. Hoses 44 and 56 are then disconnected from valves 40 and 42, respectively. Valves 40 and 42 remain in place for installation of a liquid line drier, if desired.

Following removal, the filtering element 124 should be inspected and, if excessively dirty, replaced with a fresh filter. New T-off valves can then be provided and the inventive filter assembly is then ready for use at another refrigeration system installation. Additionally, it may be advantageous to change the compressor oil in the newly changed compressor.

As mentioned above, some refrigeration systems are equipped with a king valve, liquid valve, or the like, in which case piercing valve 40 is not required. Rather, refrigerant hose 44 can be threadedly connected directly to the gauge port or service port of the king valve. All other steps remain the same as above and, once the system has been repaired and the partially rehabilitated refrigerant reintroduced into the evacuated system through piercing valve 42, the system is operated as described above. When it is determined that the inventive system can be removed, the king valve is back seated, cutting off line 44, valve 42 is closed, then valves 50 and 52 are closed, valve 58 is opened, hose 44 is disconnected from the king valve, hose 56 is disconnected from valve 42, and the system operated as usual.

It is understood that the foregoing is presented by way of example only and it not intended to limit the scope of the present invention except as set forth in the appended claims.

What is claimed is:

1. Portable apparatus for withdrawing and cleaning contaminanted liquid refrigerant from a non-functioning refrigeration system which has malfunctioned, for retaining the cleaned refrigerant and for continuously cleaning the same refrigerant after the malfunctioning refrigeration system has been repaired and set in operation, the refrigeration system including a predetermined volume of refrigerant, a compressor, a condenser coil an evaporator coil, a liquid line connecting the outlet of the condenser coil and the inlet of the evaporator coil, the portable apparatus comprising:

vertically oriented cylindrical tank means for receiving and retaining substantially all of the predetermined volume of liquid refrigerant of the non-functioning refrigeration system directly from the liquid line thereof and having upper inlet means at its upper end, and lower outlet means at its lower end;

said upper inlet means including inlet attaching means for connecting said upper inlet means in situ to the liquid line for direct liquid communication therewith downstream of the condenser coil;

said lower outlet means including outlet attaching means for connecting said lower outlet means in situ to the liquid line for direct liquid communication therewith upstream of the evaporator coil;

a liquid filter element disposed within said tank means between said inlet means and said outlet means for dividing the interior volume of said tank means into an upper contaminated liquid refrigerant receiving area and a lower clean liquid refrigerant receiving and retaining area and comprising means for liquid communication between said upper and lower areas and for cleaning the contaminated liquid refrigerant as it passes therethrough;

said upper inlet means including inlet valve means for selectively opening and closing liquid communication between said upper contaminated refrigerant receiving area and the outlet of the condenser coil via said inlet attaching means;

said lower outlet means including outlet valve means for selectively opening and closing liquid communication between said lower clean refrigerant receiving and retaining area and the liquid line upstream of the evaporator coil via said outlet attaching means; and said tank means being substantially pre-evacuated to constitute the sole means for drawing the predetermined volume of contaminated liquid refrigerant from said refrigeration system into said tank means through said upper inlet means and for retaining the predetermined volume of liquid refrigerant when communication between said lower outlet means and the liquid line upstream of the evaporator coil is closed and the compressor is not operating.

2. The apparatus of claim 1, wherein said outlet attaching means comprises piercing valve means for connecting said lower outlet means to the liquid line and for opening and closing fluid communication between said lower outlet means and the inlet of the evaporator coil.

3. The apparatus of claim 2, wherein said inlet attaching means comprises piercing valve means for connecting said upper inlet means to the liquid line and for opening and closing fluid communication between said upper inlet means and the outlet of the condenser coil.

4. The apparatus of claim 1, wherein said refrigerant filter element comprises disc-shaped filter means, said tank means comprises an upper portion defining with said filter means, said upper contaminated refrigerant receiving area and constituting substantially a lesser volume of said tank means, a lower portion defining with said filter means said lower clean refrigerant receiving and retaining area and constituting substantially a greater volume of said tank means, and means for securing said upper and lower portions together and for supporting said filter element therebetween.

5. The apparatus of claim 1, wherein said upper inlet means and said lower outlet means further include sight glass means for inspection of the contaminated and cleaned refrigerant, respectively.

6. The apparatus of claim 4, wherein said refrigerant filter element is composed of a compressed bead-type dessicant molecular sieve, the upper surface of which is formed with raised portions for increasing the filter surface area and the mass of said filter element.

7. The apparatus of claim 4 wherein said refrigerant filter element is composed of alumina, the upper surface of which is formed with raised portions for increasing the filter surface area and the mass of said filter element.

8. The apparatus of claim 4, wherein said refrigerant filter element is composed of alumina and molecular sieve material, the upper surface of which is formed with raised portions for increasing the filter surface area and the mass of said filter element.

9. The apparatus of claim 1, further including liquid line valve means for connection in situ in the liquid line between said means for connecting said inlet means and said outlet means to the liquid line for controlling refrigerant flow into said tank means, under pressure from the compressor, when said inlet valve means and said outlet valve means are open.

10. The apparatus of claim 1, wherein said tank means comprises a series of tanks comprising means for receiving and retaining substantially all of the predetermined volume of refrigerant of the refrigeration system.

11. Portable apparatus for withdrawing and cleaning contaminated liquid fluorocarbon from a system and for retaining the cleaned liquid fluorocarbon, the system including a predetermined volume of liquid fluorocarbon, the portable apparatus comprising:

vertically oriented cylindrical tank means for receiving and retaining substantially all of the predetermined volume of contaminated liquid fluorocarbon of the system and having upper inlet means, and lower outlet means;

a liquid filter element disposed within said tank means between said inlet means and said outlet means for dividing the interior volume of said tank means into an upper contaminated liquid fluorocarbon receiving area and a lower clean liquid fluorocarbon receiving and retaining area and comprising means for liquid communication between said upper and lower areas and for cleaning the contaminated liquid fluorocarbon as it passes therethrough;

said upper inlet means including inlet valve means for selectively opening and closing liquid communication to said upper receiving area directly from the volume of liquid fluorocarbon in the system;

said lower outlet means including outlet valve means for selectively opening and closing liquid communication from said lower receiving and retaining area to said system; and said tank means being pre-evacutated to constitute the sole means for drawing the contaminated liquid fluorocarbon from said system into said tank means through said upper inlet means and for retaining the cleaned liquid fluorocarbon when said lower outlet means is closed.

12. The apparatus of claim 1, wherein said tank means comprises an upper portion defining with said filter means said upper contaminated refrigerant receiving area, a lower portion defining with said filter means said lower clean refrigerant receiving and retaining area, said upper and lower portions being separable, said refrigerant filter element being supported between said upper and lower areas and means releasably securing said upper and lower portions together, whereby said refrigerant filter element may be removed, cleaned or replaced.

13. The portable apparatus of claim 11, wherein said tank means comprises an upper portion defining with said filter means said upper contaminated refrigerant receiving area, a lower portion defining with said filter means said lower clean refrigerant receiving and retaining area, said upper and lower portions being separable, said refrigerant filter element being supported between said upper and lower areas and means releasably securing said upper and lower portions together, whereby said refrigerant filter element may be removed, cleaned or replaced.

* * * * *